US011912471B2

(12) United States Patent
Bullock et al.

(10) Patent No.: US 11,912,471 B2
(45) Date of Patent: Feb. 27, 2024

(54) LID ASSEMBLY FOR A CONTAINER

(71) Applicant: YETI Coolers, LLC, Austin, TX (US)

(72) Inventors: Dustin Bullock, Austin, TX (US); Colin Darling, Austin, TX (US); Evan Goldberg, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 121 days.

(21) Appl. No.: 17/244,580

(22) Filed: Apr. 29, 2021

(65) Prior Publication Data

US 2022/0127049 A1 Apr. 28, 2022

Related U.S. Application Data

(63) Continuation-in-part of application No. 29/756,180, filed on Oct. 27, 2020, now Pat. No. Des. 957,196.

(51) Int. Cl.
*B65D 47/12* (2006.01)
*B65D 41/04* (2006.01)
(Continued)

(52) U.S. Cl.
CPC ..... *B65D 47/122* (2013.01); *A47G 19/2272* (2013.01); *B65D 41/04* (2013.01);
(Continued)

(58) Field of Classification Search
CPC ..... B65D 47/122; B65D 41/04; B65D 51/18; B65D 51/242; B65D 2251/0015; B65D 2251/0087
See application file for complete search history.

(56) References Cited

U.S. PATENT DOCUMENTS 2,181,179 A 11/1939 Eccleston
2,743,844 A 5/1956 Livingstone
(Continued)

FOREIGN PATENT DOCUMENTS

BR 112013025927 B1 3/2020
CA 187774 A 12/1918
(Continued)

OTHER PUBLICATIONS

Mar. 1, 2022—(WO) International Search Report & Written Opinion—PCT/US21/56577.
(Continued)

*Primary Examiner* — James N Smalley
(74) *Attorney, Agent, or Firm* — Banner & Witcoff, Ltd.

(57) ABSTRACT

This disclosure relates to a lid assembly that has a lid assembly for a container, such as a drinking container, that includes a lid member, and a pouring member, wherein the lid member and pouring member are releasably connected to the container. The lid member may include a body member, a handle portion connected to the body member, an internal threaded portion, an internal receiving portion, and a lid gasket member arranged in the internal receiving portion. The pouring member may include a spout collar, a spout, and a spout opening extending through the spout, wherein the spout extends from the spout collar and includes an upper end above an upper surface of the spout collar. The lid assembly has a closed orientation that prevents liquid from flowing through the opening of the pouring member and an open orientation that allows liquid to flow through the opening of the pouring member. When the lid assembly is in the closed orientation, the lid gasket member contacts both the upper end of the spout and the upper surface of the spout collar.

18 Claims, 6 Drawing Sheets

(51) Int. Cl.

| | |
|---|---|
| ***B65D 51/18*** | (2006.01) |
| ***B65D 51/24*** | (2006.01) |
| ***A47G 19/22*** | (2006.01) |

(52) U.S. Cl.

CPC ..... *B65D 51/18* (2013.01); *B65D 51/242* (2013.01); *B65D 2251/0015* (2013.01); *B65D 2251/0087* (2013.01)

(56) References Cited

U.S. PATENT DOCUMENTS 4,059,198 A 11/1977 Mumford
4,089,433 A 5/1978 Jonsson
4,427,138 A 1/1984 Heinlein
4,475,274 A * 10/1984 Beckstrom ..... B65D 47/123 264/296
D279,346 S 6/1985 Ruxton
4,606,481 A 8/1986 Conti et al.
5,071,037 A 12/1991 Moore et al.
D332,379 S 1/1993 Murphy
D376,728 S 12/1996 Richards, Sr. et al.
5,893,489 A 4/1999 Giarrante
D413,067 S 8/1999 Haley
D415,395 S 10/1999 Hunt et al.
6,041,982 A 3/2000 Cautereels et al.
6,142,341 A 11/2000 Uematsu
D456,669 S 5/2002 Munari
6,523,711 B1 2/2003 Hughes et al.
D479,800 S 9/2003 McRae
D481,640 S 11/2003 Biesecker
D485,757 S 1/2004 Roth et al.
D494,425 S 8/2004 Segura
D511,836 S 11/2005 Morano et al.
D518,716 S 4/2006 Mallet
D518,719 S 4/2006 von Spreckelsen et al.
D524,909 S 7/2006 Bakke et al.
D525,518 S 7/2006 Baldwin
7,117,654 B2 10/2006 Danks
D533,781 S 12/2006 Freisem et al.
D539,607 S 4/2007 Lapsker
D548,086 S 8/2007 Conway et al.
D573,027 S 7/2008 Bertelli
D578,394 S 10/2008 Shurtleff et al.
D579,775 S 11/2008 Dixon et al.
7,549,559 B2 6/2009 Conroy et al.
D602,369 S 10/2009 Potts et al.
D611,355 S 3/2010 Kim et al.
D615,360 S 5/2010 Joy et al.
D615,816 S 5/2010 Joy et al.
D616,703 S 6/2010 Joy et al.
D616,744 S 6/2010 Cresswell et al.
D619,010 S 7/2010 Wasson et al.
D620,316 S 7/2010 McKinney
D620,798 S 8/2010 Cresswell et al.
D621,220 S 8/2010 Lown et al.
D621,258 S 8/2010 Gullickson et al.
D622,089 S 8/2010 Daniel et al.
D623,896 S 9/2010 Wahl et al.
D625,560 S 10/2010 Olson et al.
D626,416 S 11/2010 Cresswell et al.
D627,601 S 11/2010 Eyal
D628,486 S 12/2010 Lane
D632,522 S 2/2011 Wahl et al.
D651,847 S 1/2012 Gilbert
D652,255 S 1/2012 Carland
D653,952 S 2/2012 Snyder
D654,362 S 2/2012 Weber-Trinkfass et al.
D655,172 S 3/2012 Brooks et al.
D655,581 S 3/2012 Kotani
D657,196 S 4/2012 Beyers, III
D658,006 S 4/2012 Yao
8,215,511 B1 7/2012 Lin
D664,809 S 8/2012 Eyal
D665,621 S 8/2012 Eyal
D668,913 S 10/2012 Mayer
D675,100 S 1/2013 Herbst
D680,437 S 4/2013 Bartolo et al.
D688,949 S 9/2013 Johnson et al.
D690,556 S 10/2013 Boroski
D690,987 S 10/2013 Gallen
D693,170 S 11/2013 Rosbach
D696,079 S 12/2013 Meyers et al.
D699,996 S 2/2014 De Leo
D700,012 S 2/2014 Hurley et al.
D702,506 S 4/2014 Mettler et al.
8,695,830 B2 4/2014 Meyers et al.
D703,997 S 5/2014 Munari
8,752,720 B1 6/2014 Habig et al.
D708,954 S 7/2014 Barnes et al.
D712,254 S 9/2014 Geis et al.
D712,255 S 9/2014 Geis et al.
D716,654 S 11/2014 Dubitsky et al.
D717,594 S 11/2014 Taketani et al.
D719,444 S 12/2014 Sullivan
D723,917 S 3/2015 Koffel et al.
D724,385 S 3/2015 Hurley et al.
D724,896 S 3/2015 Williams
D727,685 S 4/2015 He
D729,579 S 5/2015 Molayem
D730,694 S 6/2015 Elsaden et al.
9,120,598 B2 9/2015 Meyers et al.
9,216,843 B2 12/2015 Sorensen et al.
D747,624 S 1/2016 Walker
D751,394 S 3/2016 Chartier
D755,561 S 5/2016 Eyal
D757,496 S 5/2016 Julier et al.
D757,543 S 5/2016 Sorensen et al.
D758,859 S 6/2016 Sorensen et al.
D760,080 S 6/2016 Gorbold
D760,586 S 7/2016 Seiders et al.
D762,418 S 8/2016 Sorensen et al.
D774,363 S 12/2016 Seiders et al.
D774,837 S 12/2016 Seiders et al.
D778,725 S 2/2017 Sorensen et al.
D779,323 S 2/2017 Masrour
D781,145 S 3/2017 Seiders et al.
D781,146 S 3/2017 Seiders et al.
D781,153 S 3/2017 Blake et al.
D781,662 S 3/2017 Seiders et al.
D782,413 S 3/2017 Tsui
D783,367 S 4/2017 Seiders et al.
D784,093 S 4/2017 Boroski et al.
D784,775 S 4/2017 Seiders et al.
D786,012 S 5/2017 Hein et al.
D786,671 S 5/2017 Khetarpaul et al.
D787,266 S 5/2017 Sonnichsen et al.
D788,544 S 6/2017 Seiders et al.
D790,920 S 7/2017 Goodwin et al.
D791,542 S 7/2017 Miksovsky et al.
9,714,124 B2 7/2017 Johnson
D793,165 S 8/2017 Rummel et al.
D794,397 S 8/2017 Seiders et al.
D795,008 S 8/2017 Eyal
D795,013 S 8/2017 Shultz et al.
D795,019 S 8/2017 Seiders et al.
D796,261 S 9/2017 Khalifa et al.
D796,956 S 9/2017 Clark et al.
D797,497 S 9/2017 Sorensen et al.
D799,274 S 10/2017 Hewitt et al.
D799,906 S 10/2017 Seiders et al.
D800,501 S 10/2017 Rummel et al.
D803,632 S 11/2017 Seiders et al.
D804,304 S 12/2017 Pearson
D805,837 S 12/2017 Hager et al.
D806,468 S 1/2018 Goodwin et al.
D807,125 S 1/2018 Seiders et al.
D809,344 S 2/2018 Guthrie
D811,818 S 3/2018 Wu
D812,428 S 3/2018 Wu
D814,852 S 4/2018 Melanson et al.
D814,928 S 4/2018 Seiders et al.
D816,493 S 5/2018 Seiders et al.
D818,775 S 5/2018 Woodruff
D819,396 S 6/2018 Seiders et al.

(56) References Cited

U.S. PATENT DOCUMENTS

D828,095 S 9/2018 Jackson et al.
D831,436 S 10/2018 Seiders et al.
D836,984 S 1/2019 Sorensen et al.
D837,589 S 1/2019 Dalton
D839,054 S 1/2019 Rane et al.
D839,055 S 1/2019 Rane et al.
D839,056 S 1/2019 Rane et al.
D839,675 S 2/2019 Beckman
D842,027 S 3/2019 Boroski
D842,104 S 3/2019 Ke
D842,652 S 3/2019 Huang
D844,385 S 4/2019 Adams, Jr. et al.
D849,482 S 5/2019 Diener et al.
D850,205 S 6/2019 Hotell
D850,207 S 6/2019 Peng
D850,849 S 6/2019 Ke
D853,237 S 7/2019 Yao
10,336,510 B2 7/2019 El-Saden et al.
10,358,270 B1 7/2019 McCready et al.
D856,748 S 8/2019 Rane et al.
D856,757 S 8/2019 Seiders et al.
D857,446 S 8/2019 Bell et al.
D857,456 S 8/2019 Bell et al.
10,370,171 B1 8/2019 Krenz
D859,078 S 9/2019 Rummel et al.
D859,080 S 9/2019 Rummel et al.
D860,715 S 9/2019 Bohman et al.
10,414,556 B2 9/2019 Kim
D862,156 S 10/2019 Meyers et al.
D862,228 S 10/2019 Yao
D862,235 S 10/2019 Sanghavi
D863,888 S 10/2019 Meyers et al.
D865,448 S 11/2019 Jacobsen
D865,449 S 11/2019 Jacobsen
D865,450 S 11/2019 Acobsen
D866,258 S 11/2019 Jacobsen
D866,259 S 11/2019 Jacobsen
D866,260 S 11/2019 Jacobsen
D866,261 S 11/2019 Jacobsen
D867,067 S 11/2019 Jacobsen
D867,068 S 11/2019 Jacobsen
D867,820 S 11/2019 Jacobsen
10,472,140 B2 11/2019 Jones
D868,537 S 12/2019 Jacobsen
D868,538 S 12/2019 Jacobsen
D869,282 S 12/2019 Hawry
D871,842 S 1/2020 Yao
D873,619 S 1/2020 Shapiro et al.
D874,285 S 2/2020 Yourist
D874,941 S 2/2020 Wittek et al.
10,569,940 B2 2/2020 Davies
D877,560 S 3/2020 Lane et al.
D878,163 S 3/2020 Rane et al.
D879,559 S 3/2020 Lowette
D879,560 S 3/2020 Lowette
10,583,968 B2 3/2020 Steele et al.
D880,230 S 4/2020 Jacobsen
D883,041 S 5/2020 Park et al.
10,661,949 B2 5/2020 Hein et al.
D885,823 S 6/2020 Ayres
D886,517 S 6/2020 Bo
D887,776 S 6/2020 Bo
10,669,081 B2 6/2020 Sullivan et al.
10,683,146 B2 6/2020 Farsai et al.
D889,209 S 7/2020 Campbell et al.
D892,556 S 8/2020 Wang et al.
D892,568 S 8/2020 Haas
D893,938 S 8/2020 Kander
D893,950 S 8/2020 Bo
10,737,851 B2 8/2020 Sullivan et al.
D895,351 S 9/2020 Taylor et al.
D895,361 S 9/2020 Wang et al.
D897,158 S 9/2020 Gilmore, III et al.
10,766,673 B2 9/2020 Steinmann et al.
D897,782 S 10/2020 Lane
D899,186 S 10/2020 McLean et al.
D899,187 S 10/2020 Wang et al.
D899,188 S 10/2020 Wang et al.
D899,848 S 10/2020 Zhang
D899,859 S 10/2020 Jacobsen
D899,860 S 10/2020 Jacobsen
D900,536 S 11/2020 Yao
D900,537 S 11/2020 Yao
D900,538 S 11/2020 Yao
D900,555 S 11/2020 Chui
D900,611 S 11/2020 Hewitt et al.
D901,699 S 11/2020 Chau
D901,976 S 11/2020 Sibbert
D902,655 S 11/2020 Wang et al.
D903,403 S 12/2020 Ames
D903,405 S 12/2020 Zhang
D904,109 S 12/2020 Yao
D904,118 S 12/2020 Jacob
D904,119 S 12/2020 Jacob
D904,122 S 12/2020 Bohman et al.
D905,499 S 12/2020 Zhang
10,870,521 B2 12/2020 Fang
D907,954 S 1/2021 Ludolph
D907,959 S 1/2021 Hao
D908,425 S 1/2021 Yao
D908,433 S 1/2021 Sapire et al.
D910,368 S 2/2021 McCabe et al.
D911,099 S 2/2021 Volkoff et al.
D911,100 S 2/2021 Chen et al.
D911,101 S 2/2021 Fang
D911,110 S 2/2021 Kauffman et al.
10,919,661 B2 2/2021 Hewitt et al.
D911,771 S 3/2021 Zhang
D911,772 S 3/2021 Xie
D913,034 S 3/2021 Cornelius et al.
D914,456 S 3/2021 Lin
D915,820 S 4/2021 Ni
D915,821 S 4/2021 Ludolph
D917,230 S 4/2021 Zitron et al.
D923,406 S 6/2021 Tsigounis
D923,428 S 6/2021 Haas
D945,837 S 3/2022 Carson
D948,284 S 4/2022 Bruner
D952,405 S 5/2022 Peng
D957,196 S 7/2022 Bullock et al.
D959,915 S 8/2022 Bruner et al.
D959,916 S 8/2022 Koide
D968,173 S 11/2022 Koide
D968,895 S 11/2022 Jacob
D969,557 S 11/2022 Jacob
D973,441 S 12/2022 Vierck
D973,442 S 12/2022 Koide
D977,916 S 2/2023 Watanabe et al.
D988,800 S 6/2023 Dosanjh
2002/0190079 A1 12/2002 Hamamoto
2004/0007556 A1 1/2004 Manera et al.
2007/0114202 A1 5/2007 Lee
2007/0251956 A1* 11/2007 Wasserman ..... A47J 43/27 222/189.07
2009/0134111 A1 5/2009 Schroeder
2011/0024385 A1 2/2011 Lewis et al.
2011/0204048 A1 8/2011 Carino et al.
2013/0186918 A1* 7/2013 Menceles ..... B65D 47/06 222/567
2013/0299447 A1 11/2013 Kim
2013/0327795 A1 12/2013 Krammer
2016/0318693 A1* 11/2016 Hein ..... B65D 81/3841
2018/0078093 A1 3/2018 Petrillo et al.
2018/0237191 A1 8/2018 Sorensen et al.
2019/0263572 A1 8/2019 Keung
2019/0337686 A1 11/2019 Miros et al.
2019/0344934 A1 11/2019 Faerber et al.
2019/0357711 A1* 11/2019 Nichols ..... A47J 41/0027
2020/0375221 A1* 12/2020 Colvin ..... B65D 47/06
2021/0002041 A1 1/2021 Starner
2021/0086944 A1 3/2021 Hammond et al.
2021/0086960 A1 3/2021 Wang

(56) References Cited

U.S. PATENT DOCUMENTS

| | | | |
|---|---|---|---|
| 2021/0086967 | A1 | 3/2021 | Miyawaki |
| 2023/0002128 | A1 | 1/2023 | Jorden |
| 2023/0182953 | A1 | 6/2023 | Palladino et al. |

FOREIGN PATENT DOCUMENTS

| | | | |
|---|---|---|---|
| CA | 2783305 | C | 4/2018 |
| CN | 3397318 | | 10/2004 |
| CN | 3442392 | | 4/2005 |
| CN | 3586007 | | 12/2006 |
| CN | 204507656 | U | 7/2015 |
| CN | 303717616 | | 6/2016 |
| CN | 303789491 | | 8/2016 |
| CN | 304078584 | | 3/2017 |
| CN | 305490321 | | 12/2019 |
| CN | 305490326 | | 12/2019 |
| CN | 305591017 | | 2/2020 |
| CN | 305623489 | | 2/2020 |
| CN | 305677012 | | 4/2020 |
| CN | 305722460 | | 4/2020 |
| CN | 305987404 | | 8/2020 |
| CN | 306124636 | | 10/2020 |
| CN | 306125989 | | 10/2020 |
| CN | 306137226 | | 10/2020 |
| CN | 306138423 | | 10/2020 |
| CN | 306139115 | | 10/2020 |
| CN | 306159986 | | 11/2020 |
| CN | 306179998 | | 11/2020 |
| CN | 306186582 | | 11/2020 |
| CN | 306215652 | | 12/2020 |
| CN | 306241216 | | 12/2020 |
| CN | 306271468 | | 1/2021 |
| EM | 006303194-0001 | | 11/2020 |
| EM | 008219265-0002 | | 11/2020 |
| EM | 008229355-0001 | | 11/2020 |
| EM | 008229355-0002 | | 11/2020 |
| EM | 008087761-0002 | | 12/2020 |
| EM | 008265557-0004 | | 12/2020 |
| EM | 008265557-0006 | | 12/2020 |
| EM | 008265557-0007 | | 12/2020 |
| EM | 008323034-0001 | | 12/2020 |
| EM | 008268080-0002 | | 1/2021 |
| EM | 008383913-0010 | | 1/2021 |
| EM | 008383913-0011 | | 1/2021 |
| EM | 008406441-0001 | | 1/2021 |
| EM | 008281430-0001 | | 12/2021 |
| EP | 2432705 | B1 | 8/2013 |
| FR | 1511382 | A | 1/1968 |
| FR | 2867162 | A1 | 9/2005 |
| GB | 9008265557-0007 | | 11/2020 |
| HK | 1186635 | A1 | 3/2014 |
| IN | 307620-0001 | | 11/2019 |
| IN | 316515-001-0001 | | 12/2020 |
| JP | 2011225220 | A | 11/2011 |
| JP | 5850558 | B2 | 2/2016 |
| JP | 1594697 | S | 1/2018 |
| JP | D1636377 | | 7/2019 |
| JP | D1649045 | | 1/2020 |
| JP | 6652876 | B2 | 2/2020 |
| JP | 6681745 | B2 | 4/2020 |
| JP | D1673104 | | 11/2020 |
| JP | D1673133 | | 11/2020 |
| JP | 2020193027 | A | 12/2020 |
| JP | D1674509 | | 12/2020 |
| JP | D1674510 | | 12/2020 |
| JP | D1674511 | | 12/2020 |
| KR | 101317556 | B1 | 10/2013 |
| RU | 00117577 | U1 | 6/2012 |
| RU | 00117763 | U1 | 6/2012 |
| RU | 00123250 | U1 | 12/2012 |
| WO | 2006125078 | A3 | 11/2007 |
| WO | 2015004802 | A1 | 1/2015 |
| WO | 2015008133 | A2 | 1/2015 |
| WO | D202802-001 | | 11/2019 |
| WO | D205781-001 | | 10/2020 |
| WO | D205781-002 | | 10/2020 |
| WO | D205781-003 | | 10/2020 |
| WO | D205781-004 | | 10/2020 |
| WO | D205781-005 | | 10/2020 |
| WO | D205781-006 | | 10/2020 |

OTHER PUBLICATIONS

Jul. 12, 2021—(CN) Notice of Grant—App. No. 202130244763.1.
Sep. 29, 2021—(JP) Decision of Grant—App. No. 20218970.
KOMAX Industrial Co., Ltd., as published on company website (JPO Design Prior Art Reference No. HJ29054111).
A&F Corporation, as published on company website (JPO Design Prior Art Reference No. RJ02013058).
Sep. 29, 2021—(JP) Decision of Grant—App. No. 20218971.
Apr. 28, 2022—(CN) First Office Action—App. No. 202230128647.8.
May 16, 2023—(CN) Second Office Action—App, No. 202230128647.8.
May 11, 2023—(NZ) Design Examination Report 1—App. No. 432051.
May 11, 2023—(NZ) Design Examination Report 1—App. No. 432053.
Yeti Yonder Water Bottle, Amazon.com, First available date: Apr. 4, 2023. Retrieved from the internet Jul. 14, 2023<https:// www.amazon.com/YETI-Yonder-Water-Bottle-Seafoam/dp/BOBTTWXMTN/ref=sr_1_10?crid=2Y7KO6ZMZD5YS (Year: 2023).
May 1, 20231—(NZ) Examination Report 1—App. No. 432054.
Sep. 15, 2023—(CA) Office Action—App. No. 211131.

* cited by examiner

LID ASSEMBLY FOR A CONTAINER

CROSS-REFERENCE TO RELATED APPLICATION

This application is a continuation-in part of U.S. patent application Ser. No. 29/756,180 filed on Oct. 27, 2020. The content of the above listed application is expressly incorporated herein by reference in its entirety for any and all non-limiting purposes.

FIELD

The present disclosure herein relates broadly to containers, and more specifically to drinkware containers with lids used for drinkable beverages or foods.

BACKGROUND

A container may be configured to store a volume of liquid. Containers may be filled with hot or cold drinkable liquids, such as water, coffee, tea, a soft drink, or an alcoholic beverage, such as beer. In order to prevent the liquid from spilling, the container may have a lid that prevents the liquid from flowing from the container when the lid is in a closed orientation and allows the liquid to flow from the container when the lid is in an open orientation.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

This disclosure may relate to a lid assembly for a container that comprises a lid member and a pouring member. The lid member may be configured to releasably connect to the container and include a body member, a handle portion connecting to the body member, an internal threaded portion, an internal receiving portion, and a lid gasket member arranged in the internal receiving portion. The pouring member may include a spout collar, a spout, and a spout opening extending through the spout, where the spout extends from the spout collar and includes an upper end above an upper surface of the spout collar. The lid assembly may have a closed orientation that prevents liquid from flowing through the spout opening of the pouring member and an open orientation that allows liquid to flow through the spout opening of the pouring member. When the lid assembly is in the closed orientation, the lid gasket member may contact both the upper end of the spout and the upper surface of the spout collar. The lid gasket member may be formed from a resilient material. The internal threaded portion may be configured to releasably engage with an externally threaded portion of the container. The pouring member may be configured to releasably engage an interior surface of the container using a friction fit. The internal threaded portion of the lid member may be configured to releasably engage with an externally threaded portion of the pouring member, where the pouring member releasably engages to the container using a threaded connection. In some examples, the lid gasket member may include: (a) an upper member with a top surface and a bottom surface opposite the top surface, (b) a perimeter wall extending from the upper member, (c) an aperture extending through the upper member, (d) a protrusion extending from the bottom surface, and (e) a recess on the upper member. In addition, when the lid assembly is in the closed orientation, the protrusion on the lid gasket member may be inserted into the spout opening of the spout and the bottom surface of the upper member contacts the upper end of the spout. The lid gasket member may further include a gasket engaging member extending outward from the perimeter wall that releasably secures to a lid engaging member.

Still other aspects of this disclosure may relate to a lid assembly for a container comprising a lid member and a pouring member. The lid member may be configured to releasably connect to the container. The lid member may include a body member, a handle portion connecting to the body member, an internal threaded portion, an internal receiving portion, and a lid gasket member arranged in the internal receiving portion. The lid gasket member may include an upper member with a top surface and a bottom surface opposite the top surface, a perimeter wall extending from the upper member, and a gasket engaging member extending outward from the perimeter wall that releasably secures to a lid engaging member. The pouring member may include a spout collar, a spout, and a spout opening extending through the spout, where the spout extends from the spout collar and includes an upper end above an upper surface of the spout collar. The lid assembly may have a closed orientation that prevents liquid from flowing through the spout opening of the pouring member and an open orientation that allows liquid to flow through the spout opening of the pouring member. When the lid assembly is in the closed orientation, the bottom surface of the lid gasket member may contact the upper end of the spout and a sealing surface opposite the gasket engaging member contacts the upper surface of the spout collar. The lid gasket member may be formed from a resilient material. The internal threaded portion may be configured to releasably engage with an externally threaded portion of the container. The pouring member may releasably engage an interior surface of the container using a friction fit. The lid gasket member may include a recess on the upper member that receives a boss that extends from a top surface of the internal receiving portion of the lid member. In some examples, a spout height may be defined as a ratio of the spout height to a diameter of the spout opening, where the ratio is within a range of 0.25:1 and 0.75:1. The spout height may be defined as a vertical distance from the upper end of the spout to the upper surface of the spout collar adjacent the spout. The lid gasket member may further include a protrusion extending from the bottom surface of the upper member. When the lid assembly is in the closed orientation, the protrusion may be inserted into the spout opening.

Yet still other elements of the disclosure may relate to a lid assembly for a container comprising a lid member and a pouring member. The lid member may be configured to releasably connect to the container. The lid member may include a body member, a handle portion, an internal threaded portion, an internal receiving portion, and a lid gasket member arranged in the internal receiving portion. The lid gasket member may be formed from a resilient material and include: (a) an upper member with a top surface and a bottom surface opposite the top surface, (b) a perimeter wall extending from the upper member, (c) a protrusion extending from the bottom surface of the upper member, and (d) a gasket engaging member extending outward from the perimeter wall that releasably secures to a lid engaging member. The pouring member may include a spout collar, a spout, and a spout opening extending through the spout, where the spout extends from the spout collar and includes an upper end above an upper surface of the spout collar. The lid assembly may have a closed orientation that prevents liquid from flowing through the spout opening of the pouring member and an open orientation that allows liquid to flow through the spout opening of the pouring member. When the lid assembly is in the closed orientation, the bottom surface of the lid gasket member may contact the upper end of the spout, a sealing surface opposite the gasket engaging member may contact the upper surface of the spout collar, and the protrusion may be inserted into the spout opening. A spout height may be defined as a ratio of the spout height to a diameter of the spout opening, wherein the ratio is within a range of 0.25:1 and 0.75:1, where the spout height is defined as a vertical distance from the upper end of the spout to the upper surface of the spout collar adjacent the spout. The gasket engaging member may have a hook-like shape that engages a corresponding lid engaging member to help secure the lid gasket member to the lid member, where the corresponding lid engaging member includes a protrusion and a groove, wherein the groove is outboard and adjacent to the protrusion.

BRIEF DESCRIPTION OF DRAWINGS

The present disclosure is illustrated by way of example and not limited in the accompanying figures in which like reference numerals indicate similar elements and in which.

Further, it is to be understood that the drawings may represent the scale of different components of various examples; however, the disclosed examples are not limited to that particular scale.

DETAILED DESCRIPTION

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure. It is noted that the accompanying drawings may not be drawn to scale. It is noted that various connections between elements are discussed in the following description. It is noted that these connections are general and, unless specified otherwise, may be direct or indirect, and that the specification is not intended to be limiting in this respect.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Generally perpendicular" means that a first line, segment, plane, edge, surface, etc. is approximately (in this instance, within 5%) orthogonal with another line, plane, edge, surface, etc., over at least 50% of the length of the first line, segment, plane, edge, surface, etc.

In general this disclosure relates to a lid assembly 100 that releasably connects to a container 10. The container 10 may or may not be an insulated container to store a volume of liquid, which in some examples may be a drinking container. The lid assembly 100 may have a closed orientation to prevent liquid from flowing from the container 10 and an open orientation to allow liquid to flow from the container.

Figure 1:
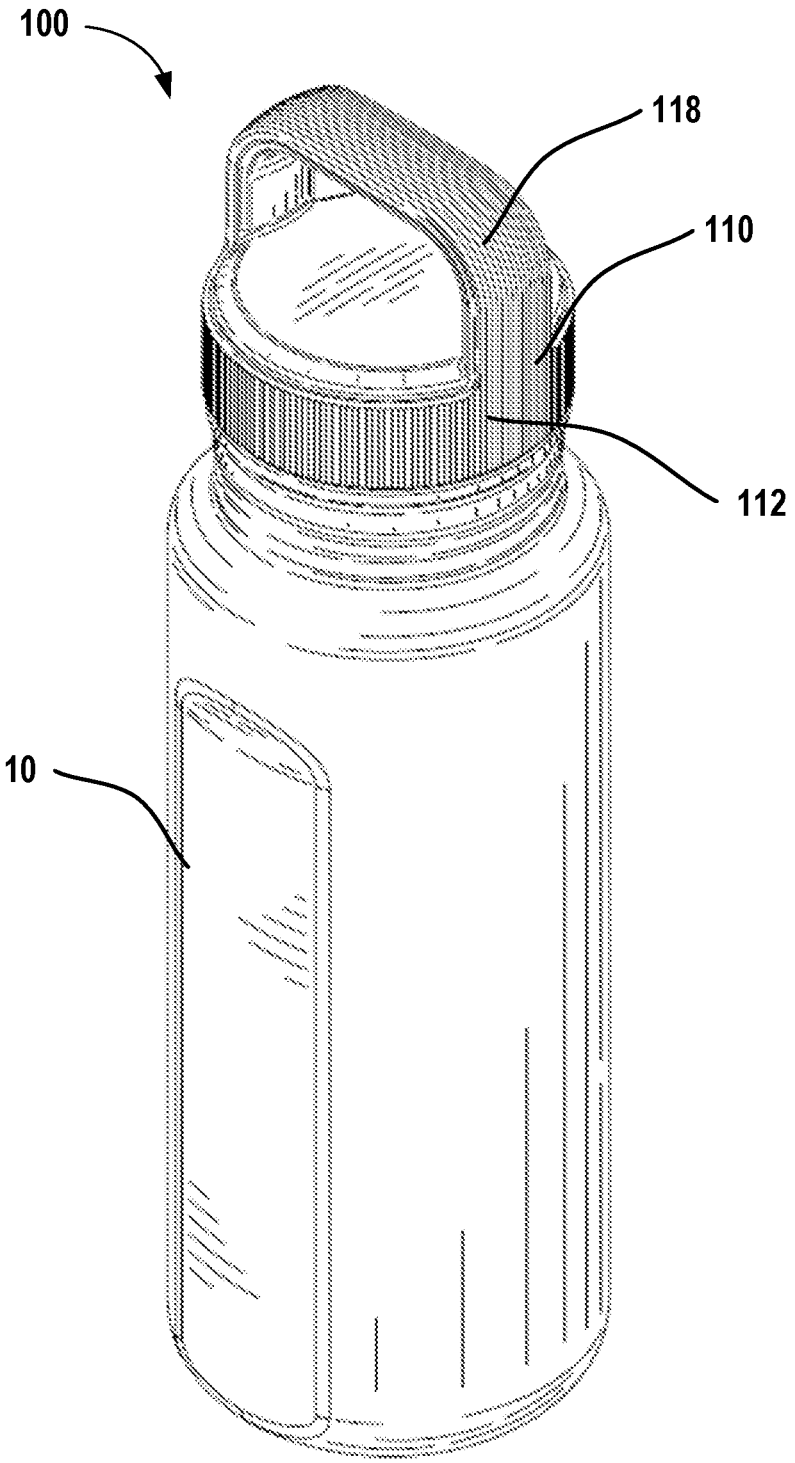
FIG. 1 depicts a top, front perspective view of an exemplary lid assembly in a closed orientation attached to a container according to one or more aspects described herein.
Figure 2:
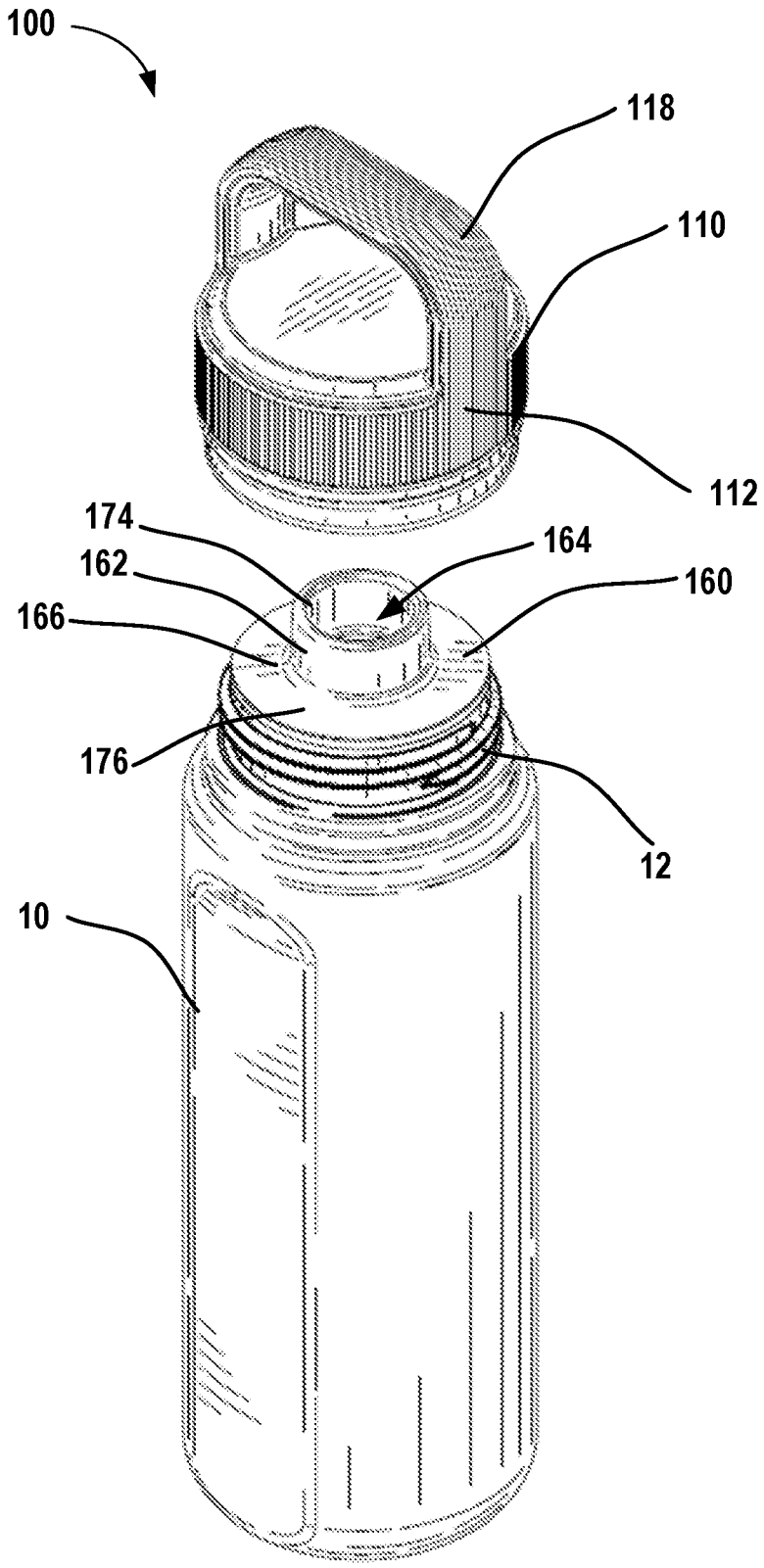
FIG. 2 depicts a top, front perspective view of the exemplary lid assembly of FIG. 1 in an open orientation attached to a container according to one or more aspects described herein.
Figure 3:
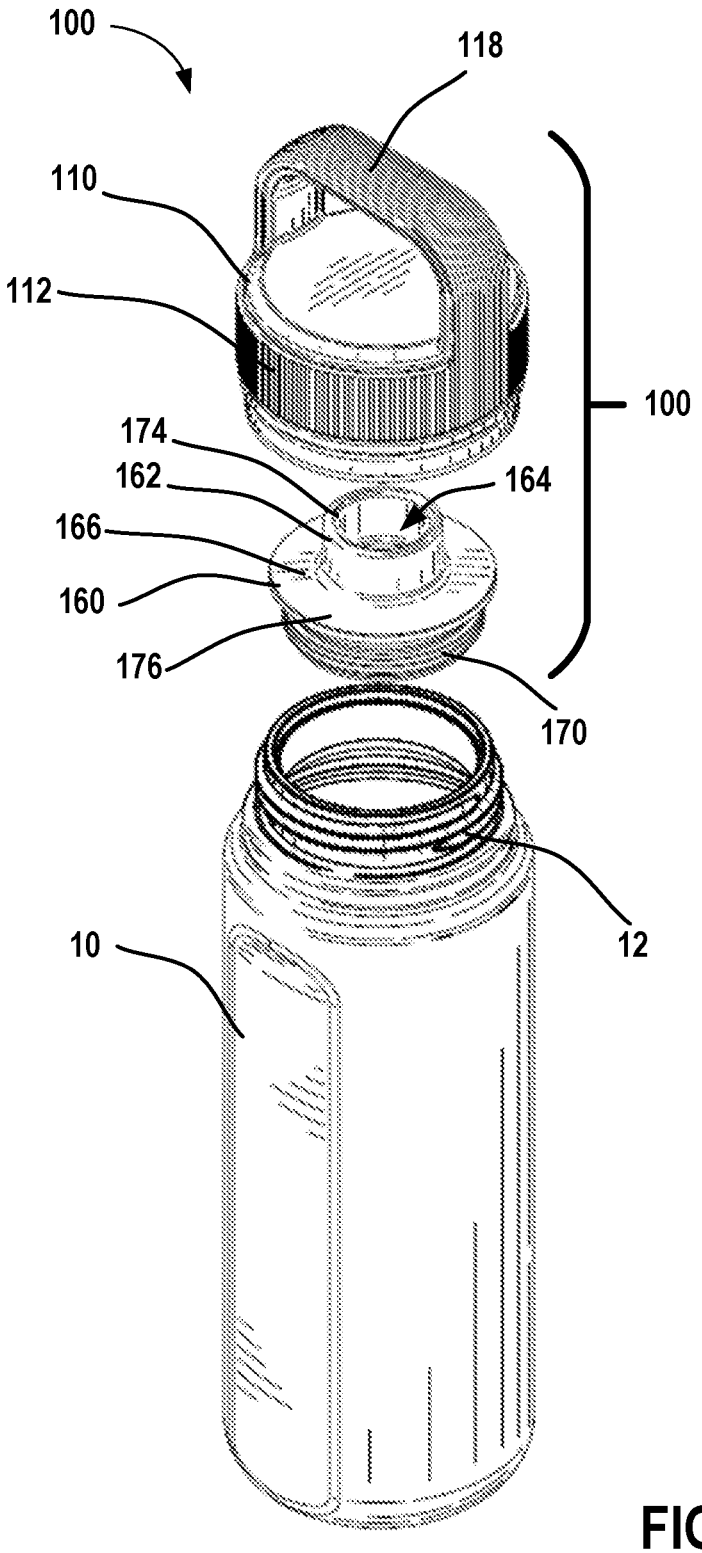
FIG. 3 depicts a partially exploded top, front perspective view of the exemplary lid assembly and container of FIG. 1 according to one or more aspects described herein.
Figure 5:
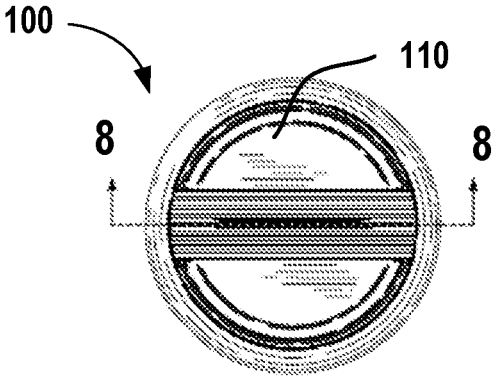
FIG. 5 depicts a side view of the exemplary lid assembly and container of FIG. 1 according to one or more aspects described herein.
Figure 4:
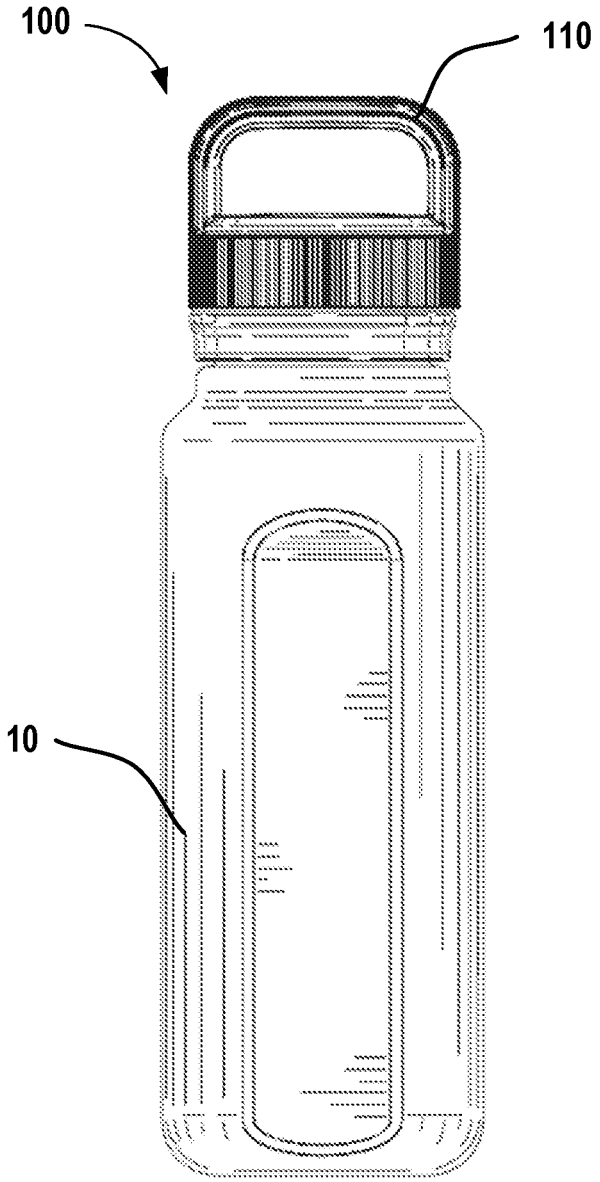
FIG. 4 depicts a front view of the exemplary lid assembly and container of FIG. 1 according to one or more aspects described herein.
Figure 6:
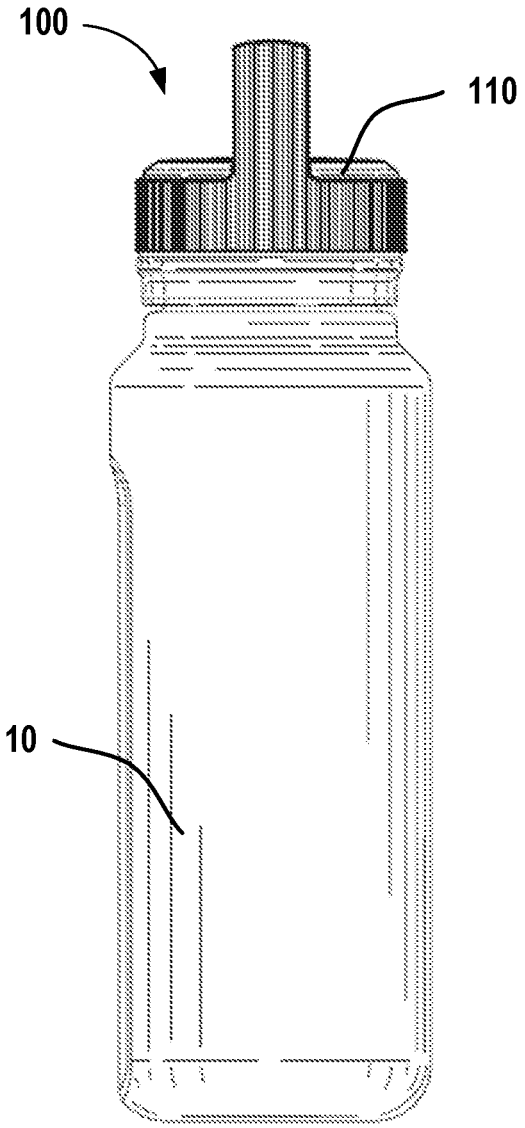
FIG. 6 depicts a top view of the exemplary lid assembly and container of FIG. 1 according to one or more aspects described herein.
Figure 8:
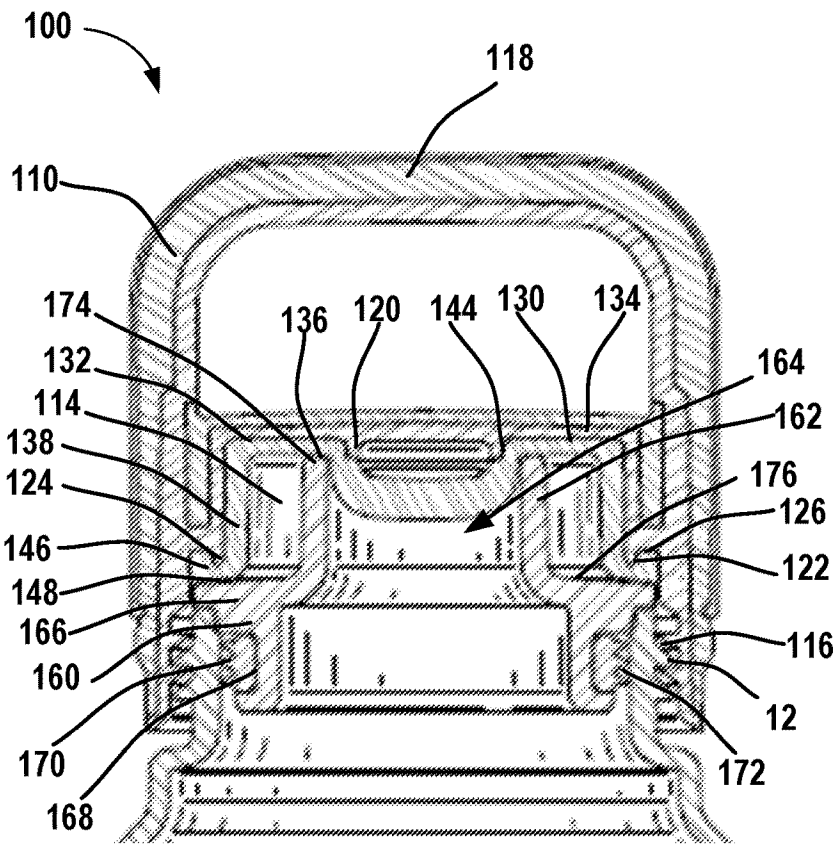
FIG. 8 depicts a partially exploded top, front view of the lid assembly of FIG. 1 according to one or more aspects described herein.
Figure 7:
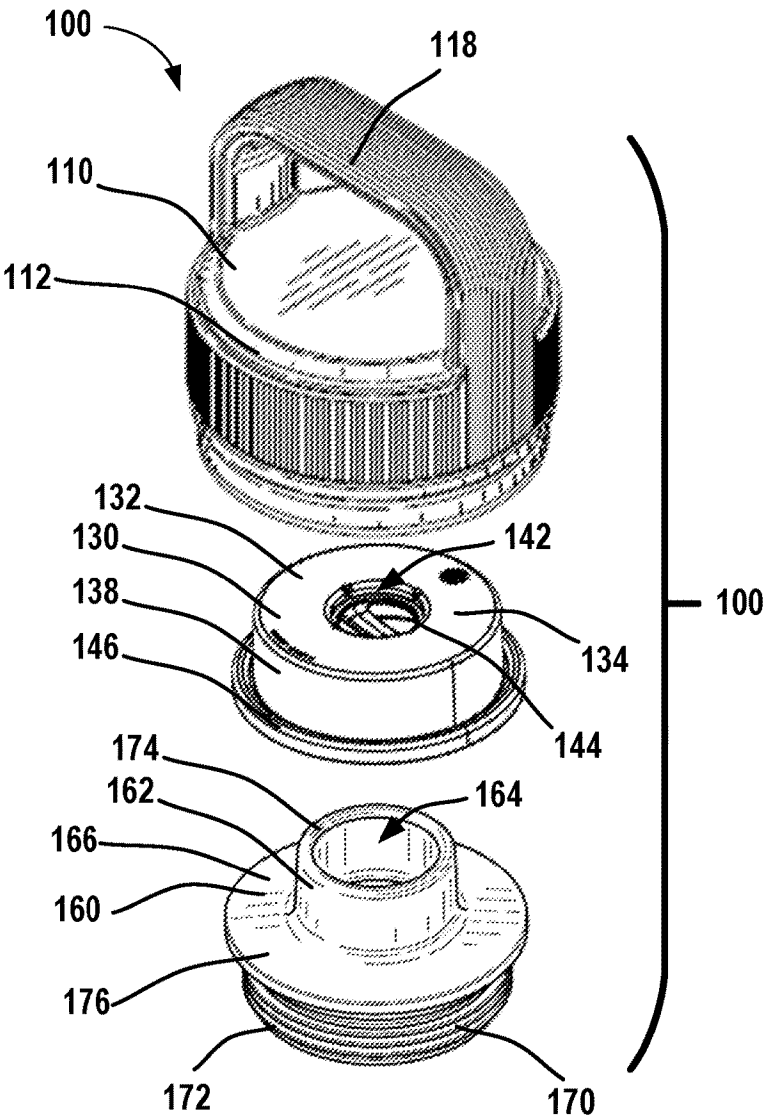
FIG. 7 depicts a cross-sectional side view of the exemplary lid assembly and container of FIG. 1 along line 7-7 of FIG. 6 according to one or more aspects described herein.
Figure 9:
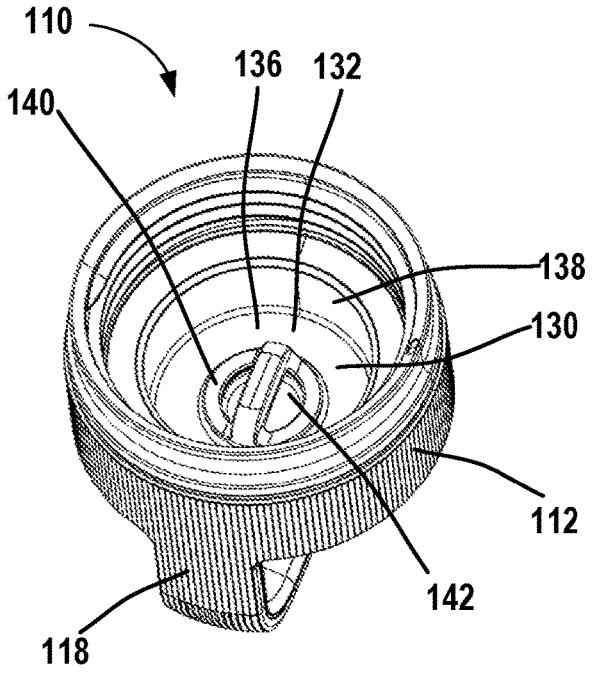
FIG. 9 depicts a bottom, front perspective view of an exemplary lid member of the lid assembly of FIG. 1 according to one or more aspects described herein.
Figure 10:
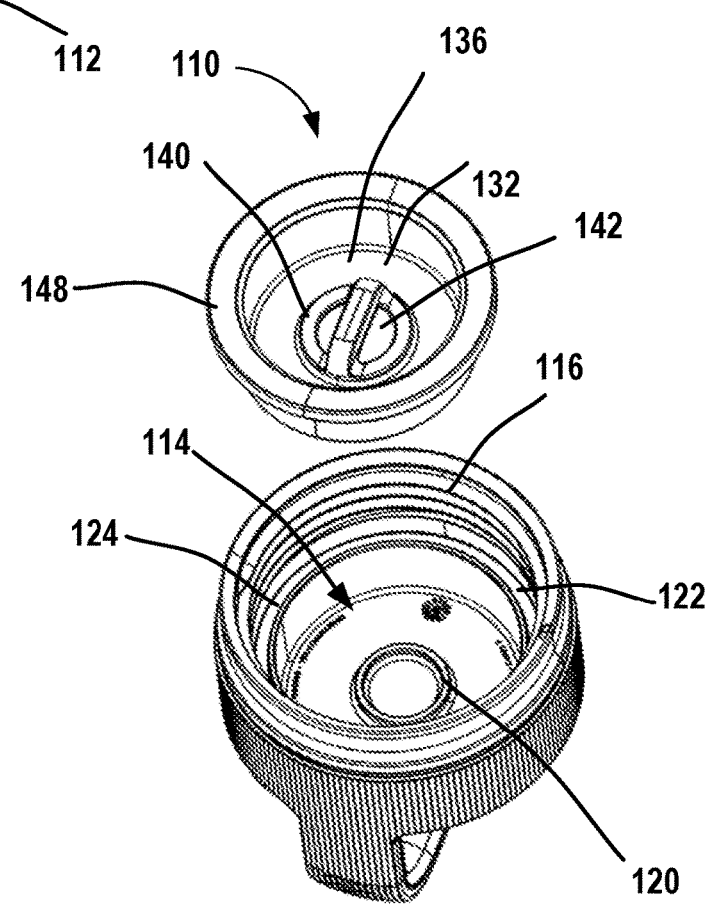
FIG. 10 depicts an exploded bottom, front perspective view of the lid member of FIG. 8 according to one or more aspects described herein.

FIGS. 1 and 4-6 illustrate views of a lid assembly 100 that is attached to a container 10 with the lid assembly 100 in a closed orientation. FIG. 2 illustrates a perspective view of the lid assembly 100 in an open orientation, where the lid member 110 is removed from the container 10 to expose the pouring member 160. When the lid assembly 100 is in the open orientation and the liquid can flow from the container 10 through a spout opening 164 in the spout 162 of the pouring member 160. The lid assembly 100 may include a lid member 110 and a pouring member 160. The lid member 110 may be configured to releasably connect to the container 10 to allow fluid to flow from the container 10 once the lid member 110 is removed or loosened from the container 10 as shown in FIG. 3. The pouring member 160 may also be releasably engaged with the container 10. The pouring member 160 may be releasably engaged with the container 10, where in some examples, the pouring member 160 may be secured to the container 10 using a friction fit.

As shown in FIGS. 7-10, the lid member 110 may include a body member 112, an internal receiving portion 114, an internal threaded portion 116, a handle portion 118 extending above the body member 112, and a lid gasket member 130. The lid gasket member 130 may be secured in the internal receiving portion 114 of the lid member 110. The pouring member 160 may include a spout 162, a spout opening 164 extending through the spout 162, a spout collar 166 that forms the main body of the pouring member 160, a groove 168 along a perimeter of the spout collar 166, and a spout gasket 170 installed in the groove 168. The spout gasket 170 may include a plurality of rings 172. The plurality of rings 172 may engage an interior surface of the container 10 to frictionally secure the pouring member 160. The spout 162 extends from the spout collar 166 and includes an upper end 174 spaced above an upper surface 176 of the spout collar 166. When the lid member 110 is in the closed orientation, the lid gasket member 130 may contact both the upper end 174 of the spout 162 and the upper surface 176 of the spout collar 166. By having at least two regions of contact with the pouring member, the lid gasket member 130 may provide a robust seal to prevent any fluid from leaking from the container 10.

The internal threaded portion 116 may be releasably engaged with an externally threaded portion 12 of the container 10. In some examples, the pouring member 160 may include an externally threaded portion, where the internal threaded portion 116 of the lid member 110 releasably engages the externally threaded portion of the pouring member 160. The lid member 110 may be formed as a unitary member from a single polymer material using an injection molding technique. Optionally, the lid member 110 may be formed with multiple polymer materials to provide different texture regions on the exterior surfaces of the body member 112 and the handle portion 118 of the lid member 110. For instance, a majority of the body member 112, the internal receiving portion 114, the internal threaded portion 116, the boss 120, and the lid engaging member 122 may be formed from a first polymer material, such as Tritan, polypropylene, or similar polymeric material, and have a second polymer material with a lower durometer either molded onto or separately applied to select regions of the external surfaces of the body member 112 and/or handle portion 118 to give a user a softer tactile feel when touching the lid member 110. The second polymer material may be a thermoplastic elastomer (TPE), thermoplastic polyurethane (TPU), or similar material.

As previously discussed, the pouring member 160 has a spout 162 that extends from the spout collar 166. The spout 162 may have a generally circular cross-sectional shape or other geometric shape surrounding the spout opening 164 that is in communication with the interior of the container 10. In some cases, the spout opening 164 may have a diameter (or the greatest distance across the spout opening 164) within a range of 20 mm and 40 mm. The spout height may be defined as the vertical distance from the upper end 174 of the spout 162 to the upper surface 176 of the spout collar 166 adjacent the spout 162. The spout height may be within a range of 10 mm and 20 mm above the upper surface 176 of the spout 162, or may be defined as a ratio of the spout height to the opening diameter, where the ratio may be approximately 0.5:1, or within a range of 0.25:1 and 0.75:1. In addition, in some examples, the pouring member 160 may have an internal threaded portion and be releasably engaged with the container 10 using a threaded connection instead of the friction fit discussed above. The pouring member 160 may be formed without the spout gasket 170 as a unitary member from a polymeric material, such as a polymeric material, such as Tritan, polypropylene, or similar polymeric material. The spout gasket 170 may be formed from a resilient material, such as such as a silicone or rubber based material.

The lid gasket member 130 may include an upper member 132 with a top surface 134 and a bottom surface 136 opposite the top surface 134. A perimeter wall 138 may extend downward and generally perpendicular from a perimeter of the upper member 132. As in the illustrated example, the upper member 132 may have a circular shape to match the shape of the internal receiving portion 114 of the lid member 110. Similarly, the perimeter wall 138 may have a generally cylindrical shape. In some examples, a protrusion 140 may extend downward from a central region of the bottom surface 136, where an aperture 142 extends through the protrusion 140 and the upper member 132. The protrusion 140 may have a shape to match the spout opening 164 of the spout 162. For example, as shown in the figures, opening 164 has a generally round cross-sectional shape and as a result, protrusion 140 has a generally circular cross-sectional shape such that when the lid assembly is in a closed orientation, the protrusion 140 may be inserted into the spout opening 164 of the spout 162 and the bottom surface 136 of the upper member 132 contacts the upper end 174 of the spout 162. The insertion of the protrusion 140 into the spout opening 164 may provide another contact or sealing region to help prevent leaks from the container 10.

The lid gasket member 130 may also include a recess 144 located in the top surface 134 of the upper member opposite the protrusion 140. The recess 144 may receive a boss 120 that extends from a top surface of the internal receiving portion 114. The reception of the boss 120 into the recess 144 may help to align and locate the lid gasket member 130 in the internal receiving portion 114. In addition, the lid gasket member 130 may include a gasket engaging member 146 extending outward from a bottom end of the perimeter wall 138. The gasket engaging member 146 may engage a corresponding lid engaging member 122 of the lid member 110. The gasket engaging member 146 may have a hook-like shape that secures to the lid engaging member 122. A sealing surface 148 may be arranged opposite the gasket engaging member 146, where the sealing surface 148 contacts the upper surface 176 of the spout collar 166 to help seal the container 10 when the lid assembly 100 is in a closed orientation. The lid engaging member 122 may include a protrusion 124 with a groove 126 adjacent to and outboard from the protrusion 124 that releasably secures to a lid engaging member. The protrusion 124 and groove 126 may extend continuously around forming a generally circular shape within the internal receiving portion 114 of the lid member 110. The groove 126 receives an end of the gasket engaging member 146 to secure the lid gasket member 130. The lid gasket member 130 may be formed from a resilient material, such as a silicone or rubber based material.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

What is claimed is:

1. A lid assembly for a container comprising:

a lid member configured to releasably connect to the container, the lid member comprising a body member, a handle portion connecting to the body member, an internal threaded portion, an internal receiving portion, wherein the internal receiving portion includes a top surface with a central portion that is free of openings and comprises an annular boss, and a lid gasket member arranged in the internal receiving portion;

a pouring member that includes a spout collar, a spout, and a spout opening extending through the spout, wherein the spout extends from the spout collar and includes an upper end above an upper surface of the spout collar, wherein the lid assembly has a closed orientation that prevents liquid from flowing through the spout opening of the pouring member and an open orientation that allows liquid to flow through the spout opening of the pouring member; and wherein the lid gasket member comprises:

an upper member with a top surface and a bottom surface opposite the top surface, a perimeter wall extending from the upper member, an aperture extending through the upper member, a protrusion extending from the bottom surface, and a recess on the top surface of the upper member, wherein the recess receives the annular boss extending from the top surface of the internal receiving portion; and wherein when the lid assembly is in the closed orientation, the lid gasket member contacts both the upper end of the spout and the upper surface of the spout collar.

2. The lid assembly of claim 1, wherein the lid gasket member is formed from a resilient material.

3. The lid assembly of claim 1, wherein the internal threaded portion is configured to releasably engage with an externally threaded portion of the container.

4. The lid assembly of claim 3, wherein the pouring member is configured to releasably engage an interior surface of the container using a friction fit.

5. The lid assembly of claim 1, wherein the internal threaded portion of the lid member is configured to releasably engage with an externally threaded portion of the pouring member.

6. The lid assembly of claim 5, wherein the pouring member releasably engages to the container using a threaded connection.

7. The lid assembly of claim 1, wherein when the lid assembly is in the closed orientation, the protrusion is inserted into the spout opening of the spout and the bottom surface of the upper member contacts the upper end of the spout.

8. The lid assembly of claim 1, wherein the lid gasket member further comprises a gasket engaging member extending outward from the perimeter wall that releasably secures to a lid engaging member.

9. A lid assembly for a container comprising:

a lid member configured to releasably connect to the container, the lid member comprising a body member, a handle portion connecting to the body member, an internal threaded portion, an internal receiving portion, wherein the internal receiving portion includes a top surface with a central portion that is free of openings and comprises an annular boss, and a lid gasket member arranged in the internal receiving portion, the lid gasket member including:

an upper member with a top surface and a bottom surface opposite the top surface, a perimeter wall extending from the upper member, a recess on the top surface of the upper member, wherein the recess receives the annular boss extending from the top surface of the internal receiving portion, and a gasket engaging member extending outward from the perimeter wall that releasably secures to a lid engaging member;

a pouring member that includes a spout collar, a spout, and a spout opening extending through the spout, wherein the spout extends from the spout collar and includes an upper end above an upper surface of the spout collar, wherein the lid assembly has a closed orientation that prevents liquid from flowing through the spout opening of the pouring member and an open orientation that allows liquid to flow through the spout opening of the pouring member; and wherein when the lid assembly is in the closed orientation, the bottom surface of the lid gasket member contacts the upper end of the spout and a sealing surface opposite the gasket engaging member contacts the upper surface of the spout collar.

10. The lid assembly of claim 9, wherein the lid gasket member is formed from a resilient material.

11. The lid assembly of claim 9, wherein the internal threaded portion is configured to releasably engage with an externally threaded portion of the container.

12. The lid assembly of claim 11, wherein the pouring member is configured to releasably engage an interior surface of the container using a friction fit.

13. The lid assembly of claim 9, wherein a spout height is defined as a ratio of the spout height to a diameter of the spout opening, wherein the ratio is within a range of 0.25:1 and 0.75:1, and wherein the spout height is defined as a vertical distance from the upper end of the spout to the upper surface of the spout collar adjacent the spout.

14. The lid assembly of claim 9, wherein the lid gasket member further includes a protrusion extending from the bottom surface of the upper member, wherein when the lid assembly is in the closed orientation the protrusion is inserted into the spout opening.

15. A lid assembly for a container comprising:

a lid member configured to releasably connect to the container, the lid member comprising a body member, a handle portion, an internal threaded portion, an internal receiving portion, wherein the internal receiving portion includes a top surface with a central portion that is free of openings and comprises an annular boss, and a lid gasket member arranged in the internal receiving portion, the lid gasket member formed from a resilient material including:

an upper member with a top surface and a bottom surface opposite the top surface, a perimeter wall extending from the upper member, a protrusion extending from the bottom surface of the upper member, a recess on the top surface of the upper member, wherein the recess receives the annular boss extending from the top surface of the internal receiving portion, and a gasket engaging member extending outward from the perimeter wall that releasably secures to a lid engaging member;

a pouring member that includes a spout collar, a spout, and a spout opening extending through the spout, wherein the spout extends from the spout collar and includes an upper end above an upper surface of the spout collar, wherein the lid assembly has a closed orientation that prevents liquid from flowing through the spout opening of the pouring member and an open orientation that allows liquid to flow through the spout opening of the pouring member; and wherein when the lid assembly is in the closed orientation, the bottom surface of the lid gasket member contacts the upper end of the spout, a sealing surface opposite the gasket engaging member contacts the upper surface of the spout collar, and the protrusion is inserted into the spout opening.

16. The lid assembly of claim 15, wherein a spout height is defined as a ratio of the spout height to a diameter of the spout opening, wherein the ratio is within a range of 0.25:1 and 0.75:1, and wherein the spout height is defined as a vertical distance from the upper end of the spout to the upper surface of the spout collar adjacent the spout.

17. The lid assembly of claim 15, wherein the gasket engaging member has a hook-like shape that engages a corresponding lid engaging member to help secure the lid gasket member to the lid member.

18. The lid assembly of claim 17, wherein the corresponding lid engaging member includes a protrusion and a groove, wherein the groove is outboard and adjacent to the protrusion.

* * * * *